US005747924A

United States Patent [19]

Usami

[11] Patent Number: 5,747,924

[45] Date of Patent: May 5, 1998

[54] PICTURE DISTORTION CORRECTING APPARATUS

[75] Inventor: Yoshihiko Usami, Kanagawa, Japan

[73] Assignee: Sony Corporation, Tokyo, Japan

[21] Appl. No.: 681,540

[22] Filed: Jul. 23, 1996

[51] Int. Cl.[6] ..... H01J 29/70

[52] U.S. Cl. ..... 313/431; 313/437; 313/442; 313/440; 335/211

[58] Field of Search ..... 313/437, 440, 313/431, 154, 442, 433; 335/210, 211, 212, 214

[56] References Cited

U.S. PATENT DOCUMENTS

| | | | |
|---|---|---|---|
| 4,257,024 | 3/1981 | Shimoma et al. | 335/210 |
| 4,433,268 | 2/1984 | Arisato | 335/211 |
| 5,194,776 | 3/1993 | Chevalier | 313/440 |
| 5,227,692 | 7/1993 | Lee | 335/214 |
| 5,378,961 | 1/1995 | Shiro et al. | 313/440 |

*Primary Examiner*—Nimeshkumar Patel
*Attorney, Agent, or Firm*—Jay H. Maioli

[57] ABSTRACT

There is provided a picture distortion correcting apparatus for correcting substantially improves a magnetic field correcting effect in which a special picture distortion corrected even when the same magnet volume as a conventional magnet is used. Rod-shaped magnets for correcting picture distortion are attached on the outside of a cathode ray tube corresponding to the upper and lower screen portions. Both the magnetic poles of the rod-shaped magnets 26 and 28 are bent toward the tube axis of the cathode ray tube. The transverse cross section of the rod-shaped magnet may have an inverse U shape. By making both the magnetic poles bent toward the tube axis of the cathode ray tube, the magnetic field correcting effect is improved, and a special picture distortion can be corrected effectively without making the magnet larger and without using a plurality of magnets.

4 Claims, 7 Drawing Sheets

FIG.7A
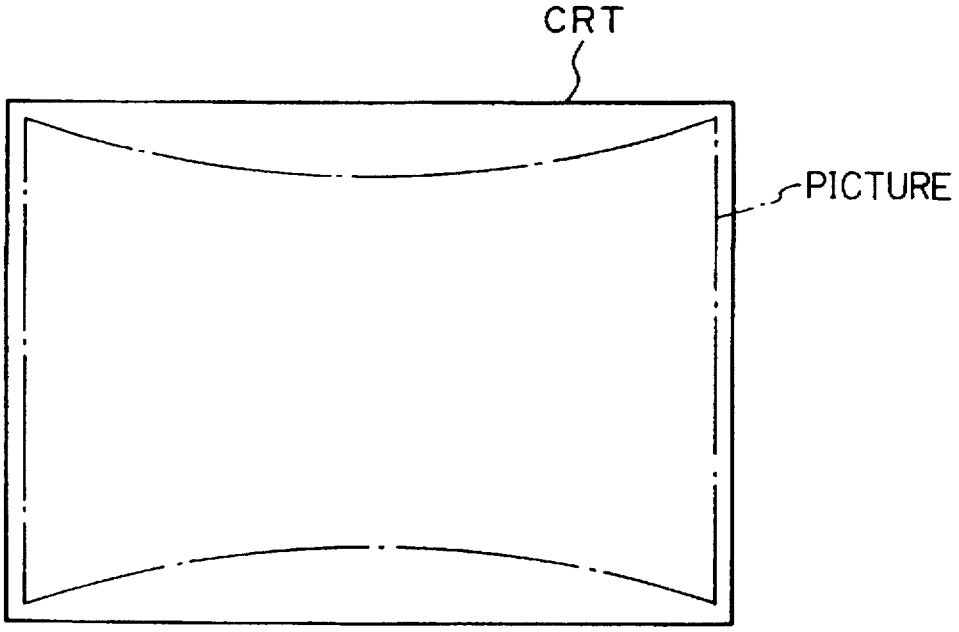
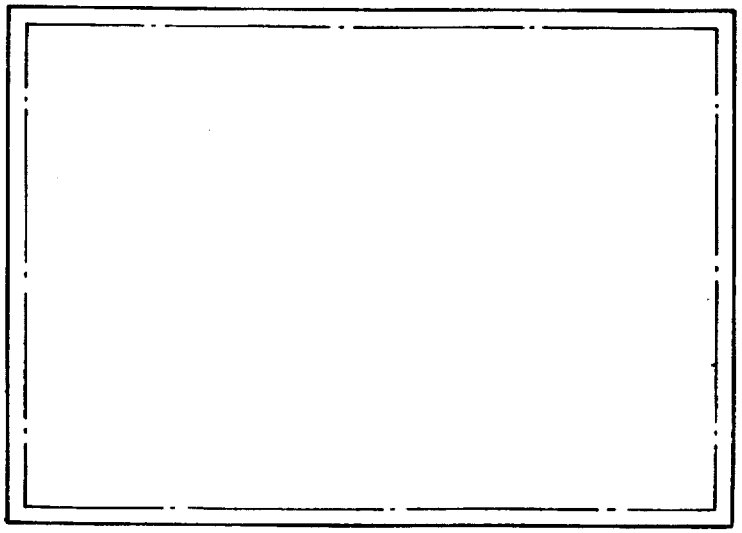
FIG.7B

FIG. 9A
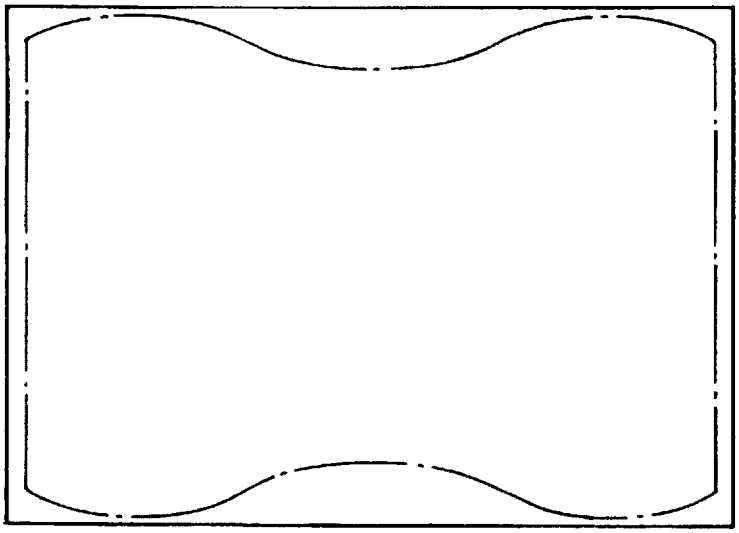
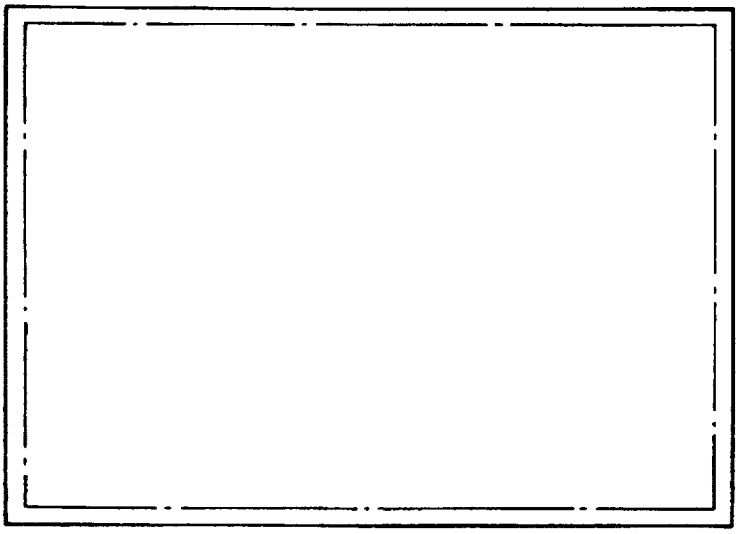
FIG. 9B

PICTURE DISTORTION CORRECTING APPARATUS

BACKGROUND OF THE INVENTION

1. Field of the Invention

The present invention relates to a picture distortion correcting apparatus which is suitably used for a wide angle cathode ray tube (CRT), a large screen CRT, a transversely wide CRT, and the like.

2. Description of the Related Art

A CRT is provided with a deflecting device to horizontally and vertically deflect electron beams. Some pictures obtained by the scanning of electron beams have a picture distortion such that a picture is distorted into a pin cushion shape in the vertical direction as shown in FIG. 7A (vertical pin cushion distortion). To correct this picture to the picture shown in FIG. 7B, a picture distortion correcting apparatus 10 as shown in FIG. 8 is usually employed.

In FIG. 8, for example, a horizontal deflection coil (not shown) is wound in a saddle shape around a coil separator (not shown), a funnel-shaped ferrite core 12 as shown in the figure is installed on the outside of the coil separator, and a vertical deflection coil 14 is wound around this ferrite core 12. A rear cover body 16 houses a color purity correcting magnet and so on.

A front cover body 20, which is in the shape of a ring as shown in the figure, is mounted on the opening side of the core 12 (CRT fluorescent material side). This front cover body 20 is a short cylindrical formed body of a size to cover a front bend portion (not shown) of the coil separator. At portions of the outer peripheral surface of the front cover body 20, that is, in this example, at upper and lower positions corresponding to the upper and lower screen portions, there are integrally formed magnet attaching portions 22 and 24. Rod-shaped magnets 26 and 28, each which are picture distortion correcting means, are mounted and fixed to the magnet attaching portions 22 and 24, respectively.

By fixing the straight rod-shaped magnets 26 and 28 having a square cross section at predetermined upper and lower positions, horizontal and vertical deflected magnetic fields are corrected by the correcting magnetic fields of these magnets. Therefore, by appropriately selecting the amount of magnetism in the rod-shaped magnets 26 and 28, the picture distortion as shown in FIG. 7A can be corrected to that in FIG. 7B.

In recent years, the demand for a wider angle, a larger screen, or a transversely longer CRT for use as a television receiver or in office automation equipment has increased. Often CRTs designed to meet this demand, have a picture distortion as shown in FIG. 9A (kite distortion).

This picture distortion is a pin cushion distortion forming a waveform. This picture distortion can be corrected by increasing the amount of magnetism in the rod-shaped magnets 26 and 28. Conventionally, the amount of magnetism of the rod-shaped magnets 26 and 28 is at a maximum, so that the amount of magnetism is increased by increasing the volume of the rod-shaped magnets 26 and 28. However, the increase in volume results in an increase in the size of the magnets 26 and 28, and in most cases, the special picture distortion as shown in FIG. 9A cannot be corrected by merely increasing the amount of magnetism.

Therefore, the aforementioned picture distortion is corrected by using separate auxiliary magnets in addition to the rod-shaped magnets used conventionally. For example, as shown in FIG. 10, auxiliary magnets 30 and 32 are fixed on the rod-shaped magnets 26 and 28, respectively, or auxiliary magnets 34 and 36 are fixed at positions indicated by chain line, or although not shown, auxiliary magnets are attached to a peripheral surface of the front cover body 20 to correct the special picture distortion shown in FIG. 9A. However, this means does not sufficiently correct this picture distortion.

OBJECT AND SUMMARY OF THE INVENTION

The present invention was made to solve the above problems, and accordingly an object thereof is to provide a picture distortion correcting apparatus which can correct the picture distortion as described above by using a simple configuration.

To solve the above problems, rod-shaped magnets for correcting picture distortion are attached on the opening side of a cathode ray tube corresponding to the upper and lower screen portions such that both the poles of the rod-shaped magnet are closer to the tube axis of the cathode ray tube.

The magnets 26 and 28 for correcting picture distortion as shown in FIG. 1 have a transverse cross section of an inverse U shape such that both the magnetic poles thereof protrude downward. If the magnets 26 and 28 of such a shape are used, both the magnetic poles **26*a* and 26*b* (28*a* and 28*b***) are closer to the tube axis of the CRT, so that the effective amount of magnetism substantially increases compared with the case where straight, rod-shaped magnets of the same volume and the same amount of magnetism are used.

In particular, on a screen shown in FIG. 9A, the maximum picture distortions occur to the right and left of the central portion. Therefore, the correcting magnetic field should be increased in the vicinity of the magnetic poles of the magnets 26 and 28. If the magnets 26 and 28 of such a shape as shown in FIG. 1, are used, the magnetic field in the vicinity of the magnetic poles of the magnets act effectively on the horizontal and vertical deflected magnetic fields, so that merely by installing the magnets 26 and 28, the picture distortion shown in FIG. 9A is corrected, and a normal picture as shown in FIG. 9B can be obtained.

Other objects, features and advantages of the present invention will become apparent in the following specification and accompanying drawings.

BRIEF DESCRIPTION OF THE DRAWINGS

FIG. 7A is a view illustrating picture distortion;

FIG. 7B is a view illustrating a corrected picture;

FIG. 9A is a view showing another example of picture distortion;

FIG. 9B is a view showing a corrected picture; and;

DESCRIPTION OF THE PREFERRED EMBODIMENT

An embodiment of a picture distortion correcting apparatus in accordance with the present invention as applied to the aforementioned CRT will be described in detail with reference to the drawings.

In the present invention, rod-shaped magnets both of the whose magnetic poles are closer to the tube axis of CRT than the central portions of the magnets; are used as the rod-shaped magnets for correcting picture distortion. A specific example thereof will be explained with reference to FIGS. 1 to 3.

In a picture distortion correcting apparatus 10 in accordance with the present invention, attaching portions 22 and 24 which are provided on the upper and lower peripheral surfaces of a front cover body 20, as described later, are designed to have a shape for accommodating a magnet respectively installed therein. Magnets 26 and 28 for correcting picture distortion are installed in the attaching portions 22 and 24, respectively.

Figure 3:
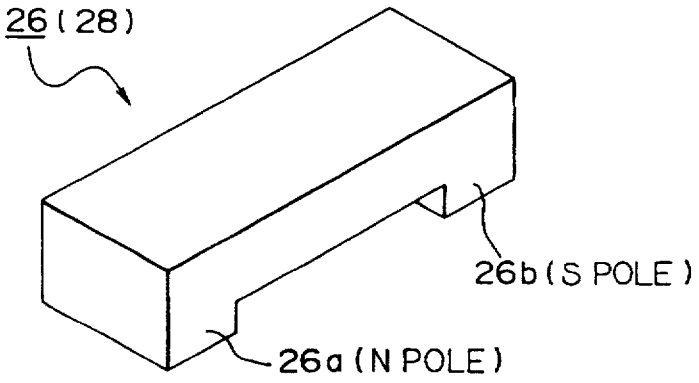
FIG. 3 is a perspective view showing an example of a rod-shaped magnet which can be used in the present invention.

In this embodiment, as shown in FIG. 3, the rod-shaped magnets 26 and 28 are of a shape such that the magnet poles 26*a* and 26*b* thereof are bent downward. The length and volume of the magnet are the same as those of a conventional straight magnet, and merely the shape is different. Both the area and protrusion length of the magnetic poles 26*a*, 26*b* may be selected appropriately.

Figure 2:
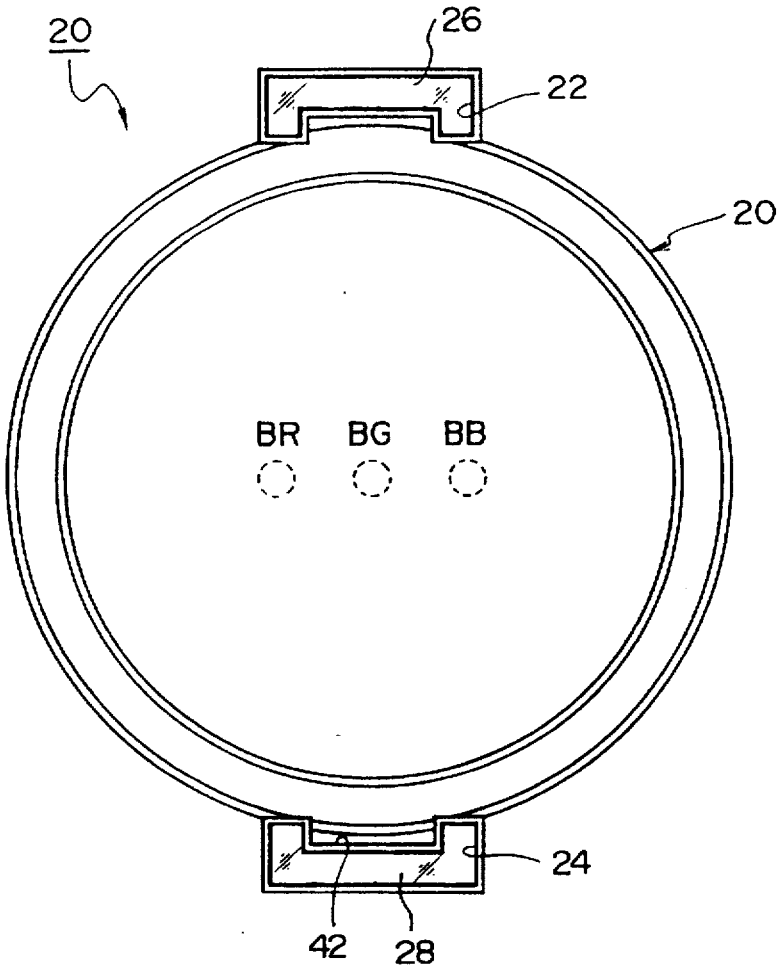
FIG. 2 is a side view of a part of the picture distortion correcting apparatus shown in FIG. 1.

When the rod-shaped magnets 26 and 28 of such a shape are installed in the attaching portions 22 and 24, respectively, both the magnetic poles 26*a* and 26*b* (28*a* and 28*b*) are closer to the tube axis of the CRT compared with conventional straight, rod-shaped magnets, as shown in FIG. 2. Therefore, even when the amount of magnetism is equal, the effective amount of magnetism of the rod-shaped magnet of this shape is larger than that of the straight rod-shaped magnet. As a result, its effect on the horizontal and vertical deflected magnetic fields is larger. In other words, the effect of the correcting magnetic fields is larger, so that even a picture distortion as shown in FIG. 9A can be effectively corrected into a correct picture as shown in FIG. 9B. In FIG. 2, BR, BG, and BB denote electron beams corresponding to R, G, and B, respectively.

Figure 1:
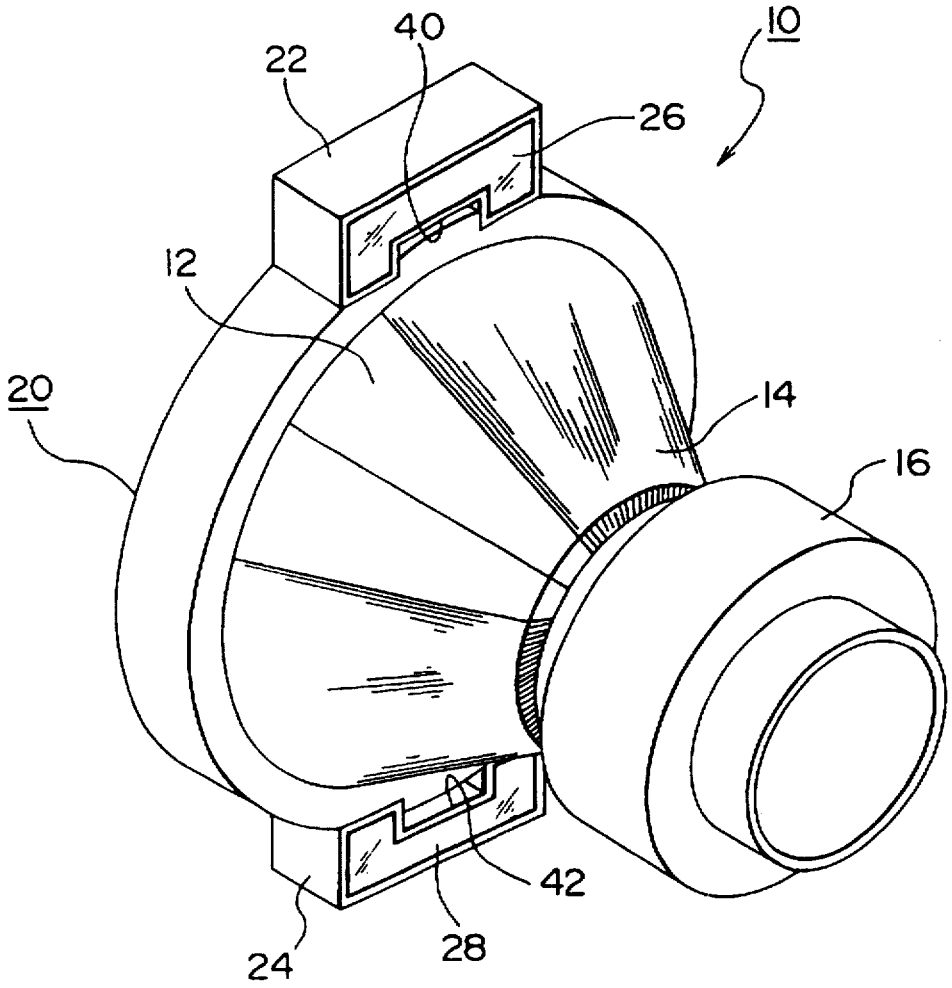
FIG. 1 is a perspective view showing an example of a picture distortion correcting apparatus in accordance with the present invention.
Figure 8:
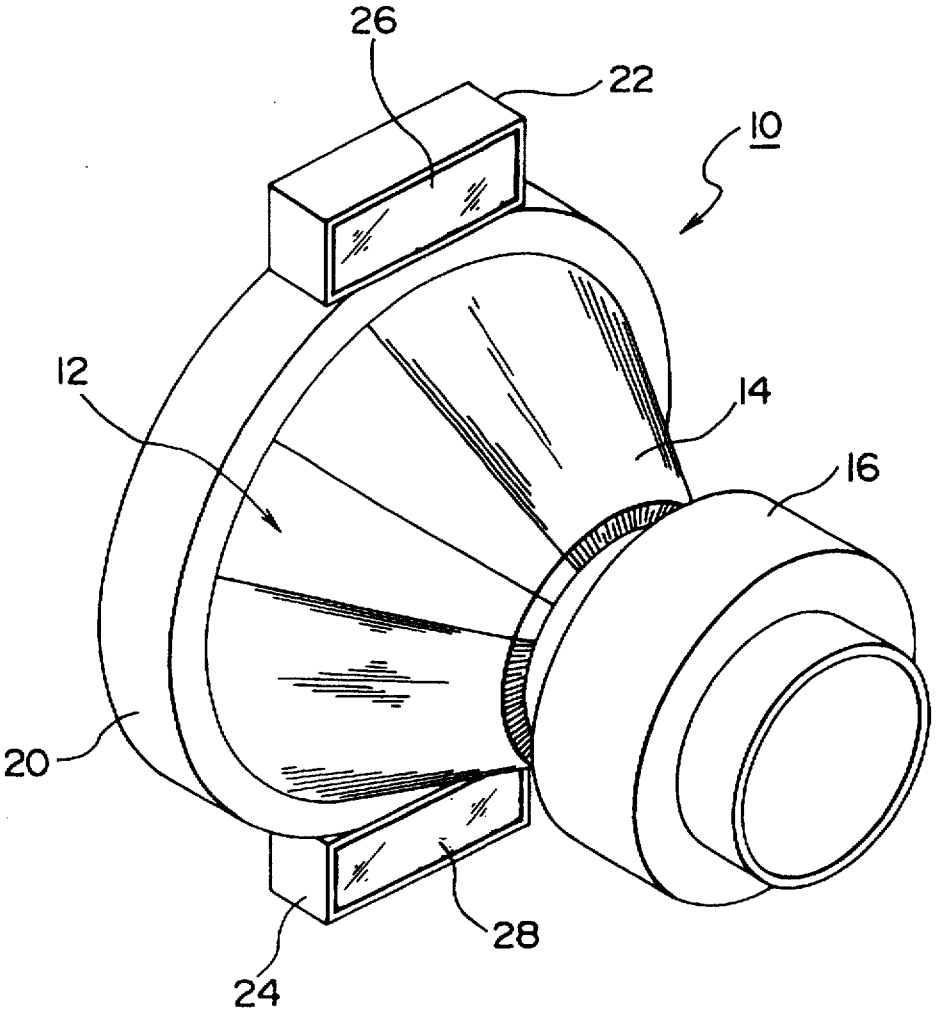
FIG. 8 PRIOR ART
FIG. 8 is a perspective view of a conventional picture distortion correcting apparatus.
Figure 10:
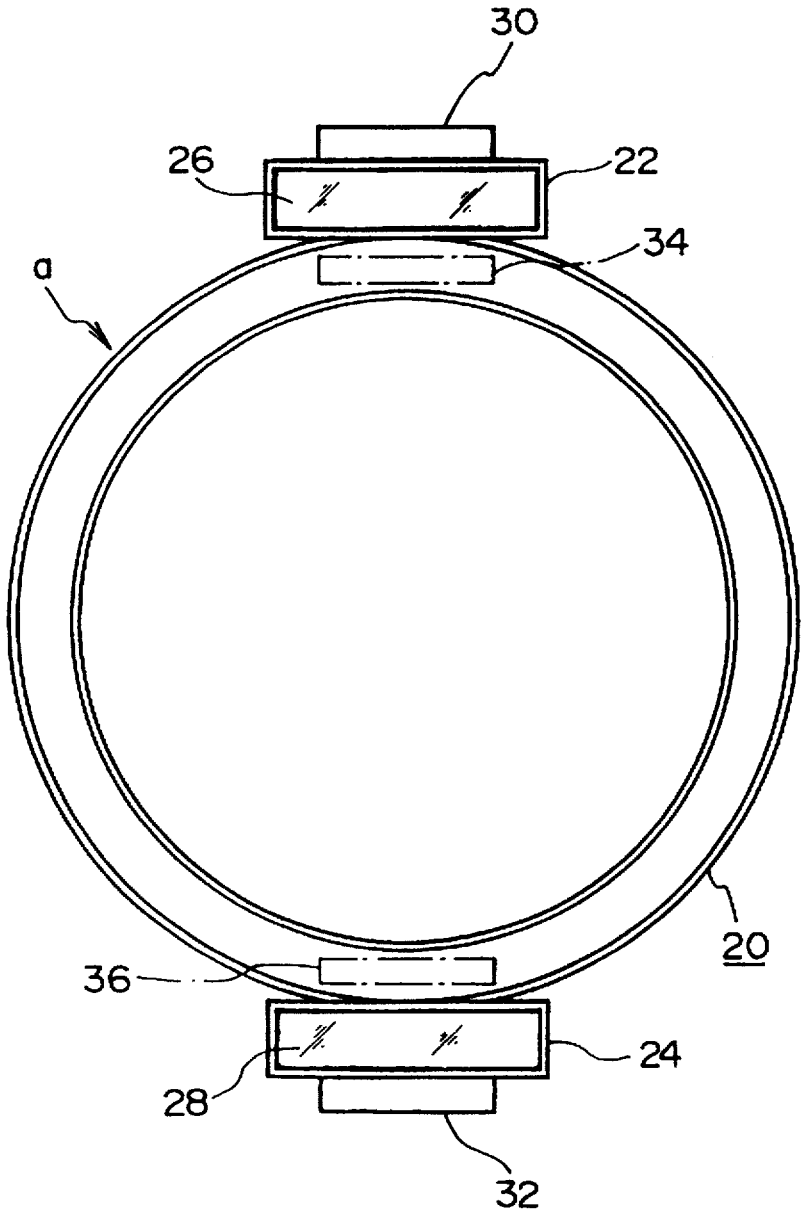
FIG. 10 PRIOR ART
FIG. 10 is a view showing an example of means for correcting the picture distortion shown in FIG. 9A.

In FIGS. 1 and 2, the magnet attaching portions 22, 24 are designed to have a shape having a concave portion 40, 42 to match the shape of the magnets 26, 28. However, these attaching portions may be constructed so as to merely have a box shape as shown in FIG. 8.

Figure 4:
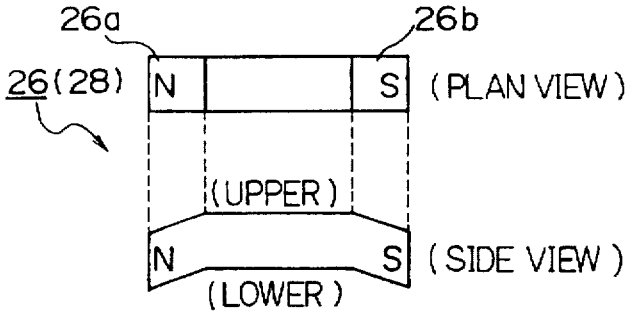
FIG. 4 is a view showing an example of a rod-shaped magnet which can be used in the present invention.
Figure 5:
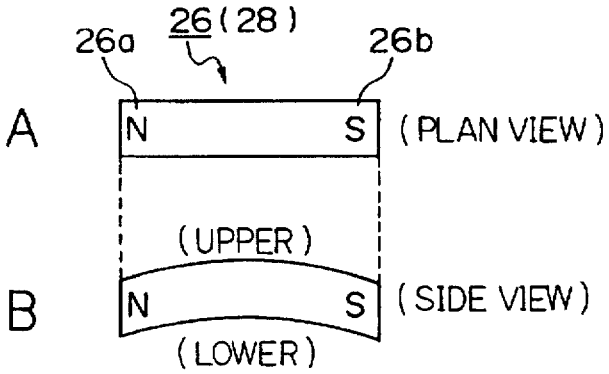
FIG. 5 is a view showing an example of a rod-shaped magnet which can be used in the present invention.
Figure 6:
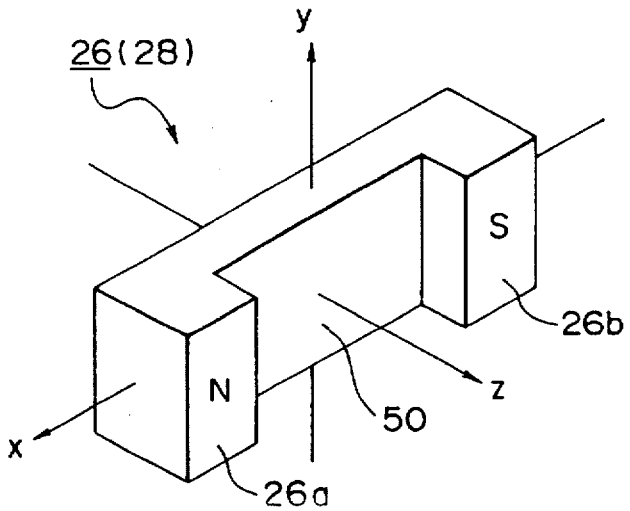
FIG. 6 is a perspective view showing an example of a rod-shaped magnet which can be used in the present invention.

FIGS. 4 to 6 show other examples of the rod-shaped magnet which can be used in the present invention. FIG. 4 shows a specific example of the rod-shaped magnet 26 in which right and left magnetic poles 26*a* and 26*b* are bent inward. By constructing the rod-shaped magnet so that both the poles are bent in such a manner, both the poles are closer to the tube axis, so that the efficiency of the correcting magnetic field can be improved, so that the picture distortion as shown in FIG. 9A can be corrected.

The length and volume of the rod-shaped magnet 26 is equal to that of the conventional straight rod-shaped magnet. The attaching portions 22, 24 of the front cover body 20, which is designed to have a shape for accommodating the rod-shaped magnet 26, can be used. The other rod-shaped magnet 28 is constructed in the same manner.

Of the rod-shaped magnets 26, 28 having constructions shown in FIGS. 4 to 6, the magnet having the shape shown in FIG. 4 has the largest effect in correcting picture distortion, the magnet of the shape shown in FIG. 6 has the second largest effect, and the magnet of the shape shown in FIG. 5 has the smallest effect.

The rod-shaped magnets 26, 28 shown in FIG. 5 are formed to have an arcuate shape. The curvature of the arc is approximately equal to that of the peripheral surface of the front cover body 20. For such rod-shaped magnets 26, 28, the poles thereof are closer to the tube axis, so the efficiency of the correcting magnetic fields is improved, so that the picture distortion as shown in FIG. 9A can be corrected.

Therefore, the rod-shaped magnet used for correcting picture distortion may be formed such that both the poles thereof are closer to the tube axis of the CRT than a conventional straight magnet. For example; the rod-shaped magnet can be constructed as shown in FIG. 6, in which the rod-shaped magnet is arranged to have its poles directed in the tube axis direction (z direction). In this case, correction is made more strongly in the tube axis direction.

As described above, in the picture distortion correcting apparatus in accordance with the present invention, the rod-shaped magnets are constructed so that both the magnetic poles thereof are closer to the tube axis than conventional straight magnets and are used to correct picture distortion.

According to the present invention, by making both the magnetic poles closer to the tube axis, the effective correcting magnetic field acting on the electron beams is increased even if the amount of magnetism is equal to that of straight rod-shaped magnets of the same length and volume thus effectively correcting picture distortion. Therefore, the present invention is capable of using a magnet of the same volume as a straight magnet to effectively correcting a special picture distortion such as a kite shaped distortion merely by using a single magnet.

Therefore, as described above, the present invention is very suitably applied to a television receiver etc. having a wide angle, large screen, or a wide CRT.

As many apparently different embodiments of this invention may be made without departing from the spirit and scope of the claims, it is to be understood that the invention is not limited to the specific embodiments described herein.

What is claimed is:

1. A picture distortion correcting apparatus for correcting picture distortion in a cathode ray tube, said apparatus comprising:

a pair of magnets attached to upper and lower portions of a front cover located at a front end of a cathode ray tube opposite a neck thereof, each of said pair of magnets having a generally longitudinal body with respective magnetic pole ends directed away and offset from a longitudinal axis of said longitudinal body such that said magnetic pole ends of each of said pair of magnets are closer to a central longitudinal axis of said cathode ray tube than said longitudinal axis of said longitudinal body of each of said pair of magnets.

2. The picture distortion correcting apparatus according to claim 1, wherein said magnetic pole ends of each of said pair of magnets are bent toward said central longitudinal axis of said cathode ray tube.

3. A picture distortion correcting apparatus for correcting picture distortion in a cathode ray tube, said apparatus comprising:

a pair of magnets attached to upper and lower portions of a front cover located at a front end of a cathode ray tube opposite a neck thereof, each of said pair of magnets having a central body with respective magnetic pole ends extending from said central body, said magnetic pole ends of each of said pair of magnets being positioned closer to a central longitudinal axis of said cathode ray tube than said central body of each of said pair of magnets, wherein a transverse cross section of each of said pair of magnets is of an inverse U shape.

4. A picture distortion correcting apparatus for correcting picture distortion in a cathode ray tube, said apparatus comprising:

a pair of magnets attached to upper and lower portions of a front cover located at a front end of a cathode ray tube opposite a neck thereof, each of said pair of magnets having a central body with respective magnetic pole ends extending from said central body, said magnetic pole ends of each of said pair of magnets being positioned closer to a central longitudinal axis of said cathode ray tube than said central body of each of said pair of magnets, wherein a transverse cross section of each of said pair of magnets is of an arcuate shape.

* * * * *